US006772542B2

(12) United States Patent
Jacobson

(10) Patent No.: US 6,772,542 B2
(45) Date of Patent: Aug. 10, 2004

(54) SKI SYSTEM

(76) Inventor: Jeffrey D. Jacobson, P.O. Box 86, Finley, ND (US) 58230

( * ) Notice: Subject to any disclaimer, the term of this patent is extended or adjusted under 35 U.S.C. 154(b) by 62 days.

(21) Appl. No.: 10/059,524

(22) Filed: Jan. 30, 2002

(65) Prior Publication Data

US 2002/0084624 A1 Jul. 4, 2002

Related U.S. Application Data

(63) Continuation-in-part of application No. 09/687,958, filed on Oct. 12, 2000, now abandoned.

(51) Int. Cl.[7] ..... A43B 5/04

(52) U.S. Cl. ..... 36/122; 280/604; 280/600

(58) Field of Search ..... 280/604, 600, 280/606, 609, 611, 615, 619, 14.21; 36/7.6, 114, 115, 122, 132; D2/914

(56) References Cited

U.S. PATENT DOCUMENTS

| | | | | | |
|---|---|---|---|---|---|
| 1,526,904 | A | * | 2/1925 | Denning | 280/600 |
| 1,783,833 | A | * | 12/1930 | Elsner | 280/604 |
| 2,412,474 | A | * | 12/1946 | Scott-Paine et al. | 36/7.5 |
| 2,914,335 | A | * | 11/1959 | Rivard | 280/604 |
| 3,506,279 | A | * | 4/1970 | Lambert | 280/826 |
| 3,600,829 | A | * | 8/1971 | Violette | 36/124 |
| 3,874,315 | A | * | 4/1975 | Wright | 114/67 A |
| 3,965,585 | A | * | 6/1976 | Stewart | 36/125 |
| 4,004,355 | A | * | 1/1977 | Koblick | 36/122 |
| 4,351,121 | A | | 9/1982 | Wallace | 36/125 |
| 4,353,573 | A | * | 10/1982 | Morgan | 280/606 |
| 4,674,764 | A | | 6/1987 | Miesen | 280/604 |
| 4,705,290 | A | * | 11/1987 | Gratz et al. | 280/604 |
| 5,398,957 | A | * | 3/1995 | Leighton et al. | 280/600 |
| D362,108 | S | * | 9/1995 | Leighton et al. | D2/914 |
| 5,469,643 | A | * | 11/1995 | Forrest | 36/122 |
| 5,577,754 | A | * | 11/1996 | Hwu | 280/605 |
| 5,881,477 | A | * | 3/1999 | Watson | 36/122 |
| 6,163,984 | A | * | 12/2000 | Faber et al. | 36/125 |

FOREIGN PATENT DOCUMENTS

| | | | | |
|---|---|---|---|---|
| CH | 213007 | * | 4/1941 | 280/11.13 |
| CH | 674946 A5 | * | 8/1990 | A63C/5/044 |
| DE | 1033567 | * | 7/1958 | A63C/15/19 |
| GB | 473231 | * | 10/1937 | |
| WO | WO 9324192 | * | 12/1993 | A63C/7/06 |

* cited by examiner

*Primary Examiner*—Brian L. Johnson
*Assistant Examiner*—J. Allen Shriver

(57) ABSTRACT

A ski system for allowing a ski to slide in forward motion and grip in backward motion for a variety of people in a cost effective manner. The ski system includes a flat base member having an upper surface and a lower surface, a plurality of gripping members extending from the lower surface of the base member, and a securing structure attached to the upper surface of the base member for securing a shoe of a user. The gripping members each have a front portion having a downwardly angled structure. The gripping members each include a rear portion that extends upwardly from the lower end of the front portion towards the lower surface of the base member. The gripping members preferably have a U-shaped cross sectional shape. The front portion of the gripping members are for gliding upon a snow surface allowing forward movement and the rear portion is for engaging the snow surface for preventing rearward movement.

10 Claims, 5 Drawing Sheets

SKI SYSTEM

CROSS-REFERENCE TO RELATED U.S. PATENT APPLICATION

I hereby claim benefit under Title 35, U.S. Code, Section 120 of U.S. patent application Ser. No. 09/687,958 filed Oct. 12, 2000. This application is a continuation-in-part of the Ser. No. 09/687,958 application. The Ser. No. 09/687,958 application has been abandoned. The Ser. No. 09/687,958 application is hereby incorporated by reference into this application.

BACKGROUND OF THE INVENTION

1. Field of the Invention

The present invention relates generally to snow skiing and more specifically it relates to a ski system for allowing an individual to travel upwardly upon a steep incline while allowing them to travel downwardly in a forward motion as conventional skis.

2. Description of the Prior Art

Snow skis have been in use for years. Typically, a snow ski is constructed for allowing forward motion that is used in downhill or cross-country situations. Some skis even prevent reverse motion for ease of walking without removing the ski by utilizing complex mechanical structures.

One of the problems with the previously mentioned anti-reverse ski is that they are often clumsy and difficult to operate, especially to young children who have an interest in skiing. Another problem with the prior art is that by adding devices to prevent reverse motion there is added weight and cost, making the prior art impractical to a wide variety of skiers.

Examples of patented snow skis which are illustrative of such prior art include U.S. Pat. No. 5,577,754 to Hwu; U.S. Pat. No. 3,858,894 to Ver et al.; U.S. Pat. No. 4,919,447 to Jackson et al.; U.S. Pat. No. 4,705,290 to Gratz et al.; U.S. Pat. No. 4,431,209 to Volkl et al.; U.S. Pat. No. 4,223,909 to Danner et al.; U.S. Pat. No. 4,118,050 to Schnurrenberger; U.S. Pat. No. 1,714,352 to Echola.

While these devices may be suitable for the particular purpose to which they address, they are not as suitable for allowing a ski to slide in forward motion and grip in backward motion for a variety of people in a cost effective manner. One of the problems with the previously mentioned anti-reverse ski is that they are often clumsy and difficult to operate, especially to young children who have an interest in skiing. Another problem with the prior art is that by adding devices to prevent reverse motion there is added weight and cost, making the prior art impractical to a wide variety of skiers.

In these respects, the ski system according to the present invention substantially departs from the conventional concepts and designs of the prior art, and in so doing provides an apparatus primarily developed for the purpose of allowing a ski to slide in forward motion and grip in backward motion for a variety of people in a cost effective manner.

SUMMARY OF THE INVENTION

In view of the foregoing disadvantages inherent in the known types of snow skis now present in the prior art, the present invention provides a new ski system construction wherein the same can be utilized for allowing a ski to slide in forward motion and grip in backward motion for a variety of people in a cost effective manner.

The general purpose of the present invention, which will be described subsequently in greater detail, is to provide a new ski system that has many of the advantages of the snow skis mentioned heretofore and many novel features that result in a new ski system which is not anticipated, rendered obvious, suggested, or even implied by any of the prior art snow skis, either alone or in any combination thereof.

To attain this, the present invention generally comprises a flat base member having an upper surface and a lower surface, a plurality of gripping members extending from the lower surface of the base member, and a securing structure attached to the upper surface of the base member for securing a shoe of a user. The gripping members each have a front portion having a downwardly angled structure. The gripping members each include a rear portion that extends upwardly from the lower end of the front portion towards the lower surface of the base member. The gripping members preferably have a U-shaped cross sectional shape.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a ski system that will overcome the shortcomings of the prior art devices.

A second object is to provide a ski system for allowing a ski to slide in forward motion and grip in backward motion thereby making walking possible.

Another object is to provide a ski system that is easy to operate for people of all ages and sizes.

An additional object is to provide a ski system that is affordable to people of all ages and sizes.

A further object is to provide a ski system that is lightweight and durable.

Another object is to provide a ski system that children can easily learn to ski with.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
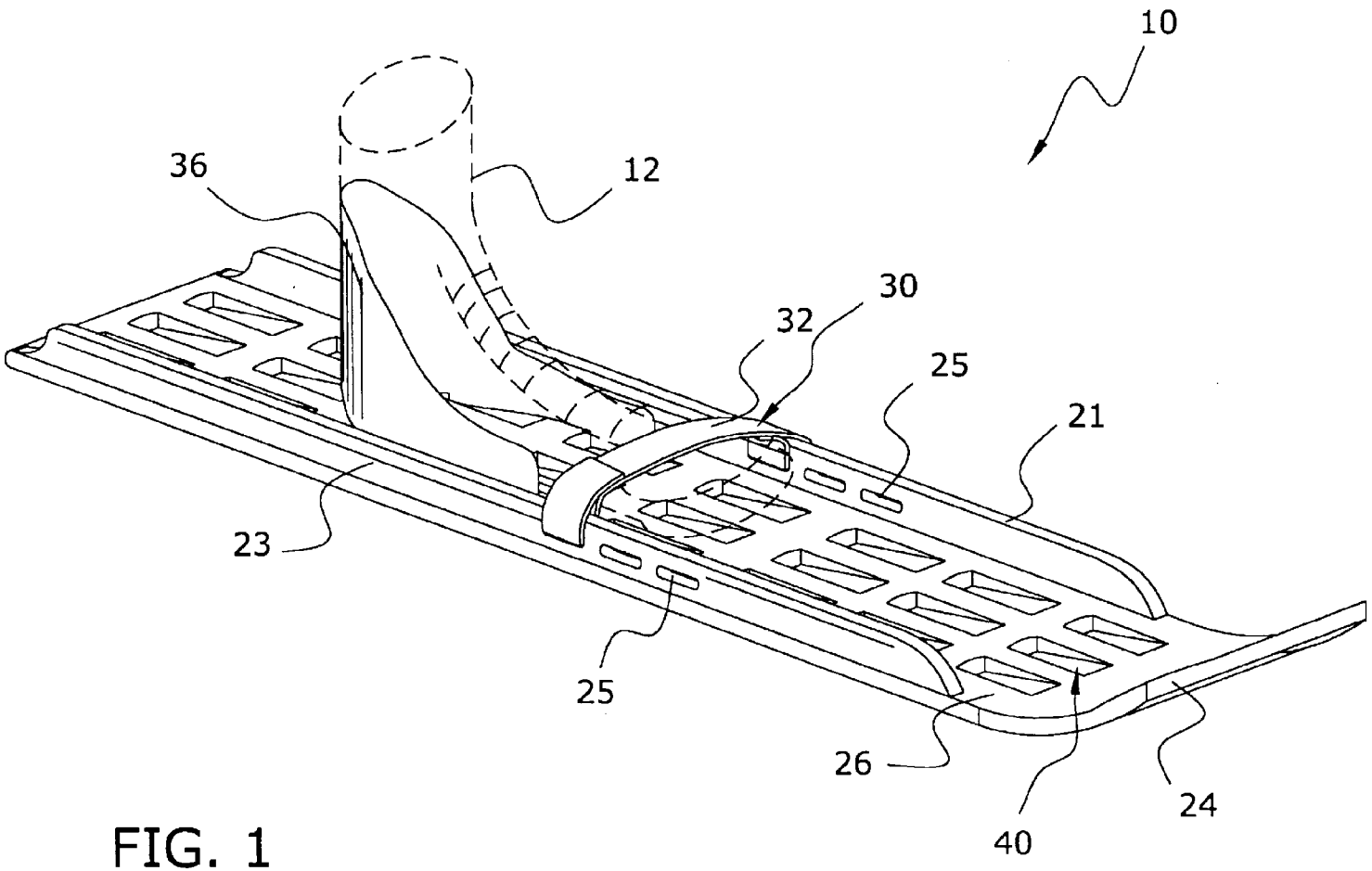
FIG. 1 is an upper perspective view of the present invention with a shoe positioned within.

Turning now descriptively to the drawings, in which similar reference characters denote similar elements throughout the several views, FIGS. 1 through 5 illustrate a ski system 10, which comprises a flat base member 20 having an upper surface 26 and a lower surface 28, a plurality of gripping members 40 extending from the lower surface 28 of the base member 20, and a securing structure 30 attached to the upper surface of the base member 20 for securing a shoe of a user. The gripping members 40 each have a front portion 42 having a downwardly angled structure. The gripping members 40 each include a rear portion 44 that extends upwardly from the lower end of the front portion 42 towards the lower surface 28 of the base member 20. The gripping members 40 preferably have a U-shaped cross sectional shape.

Figure 2:
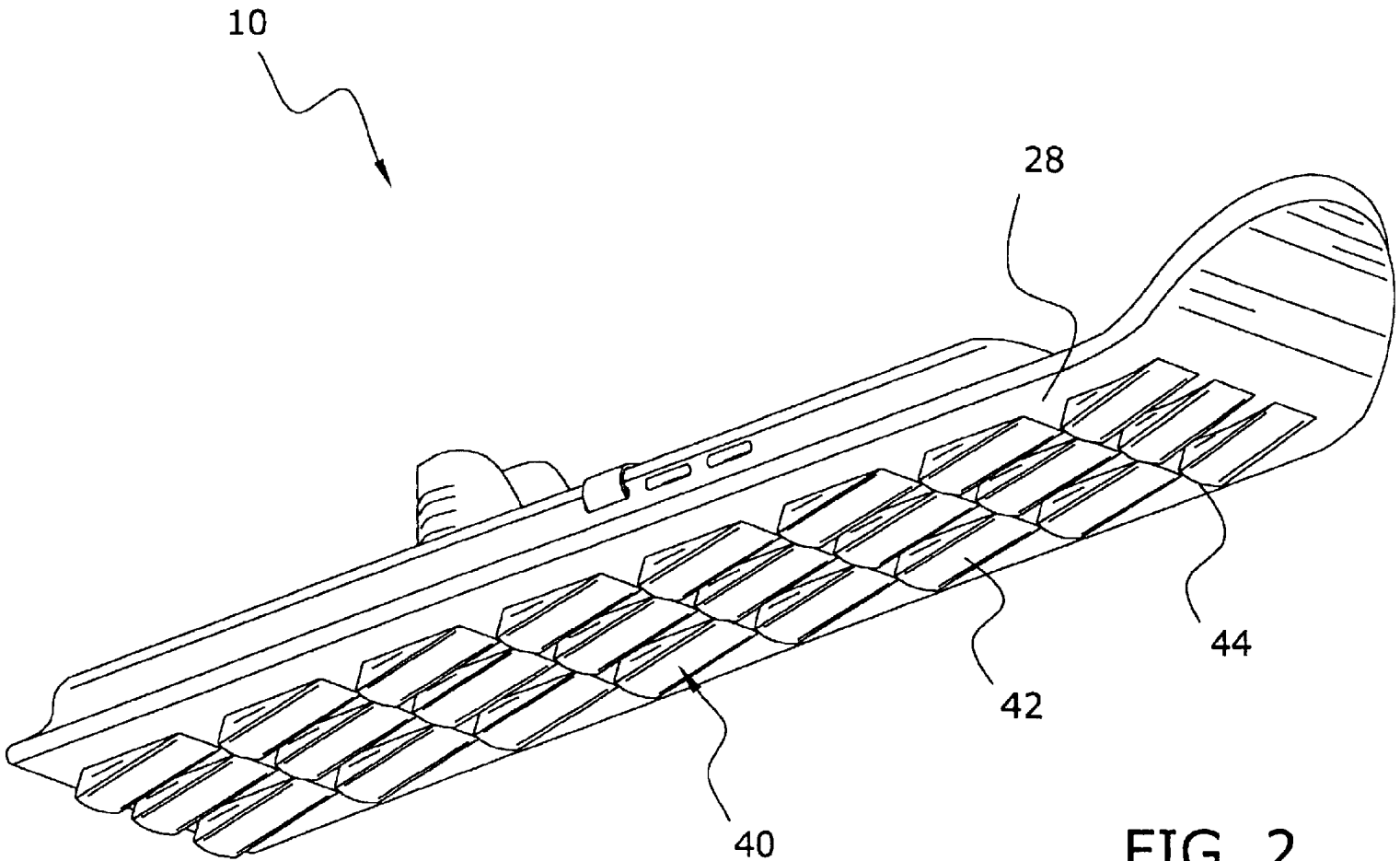
FIG. 2 is a lower perspective view of the present invention.
Figure 3:
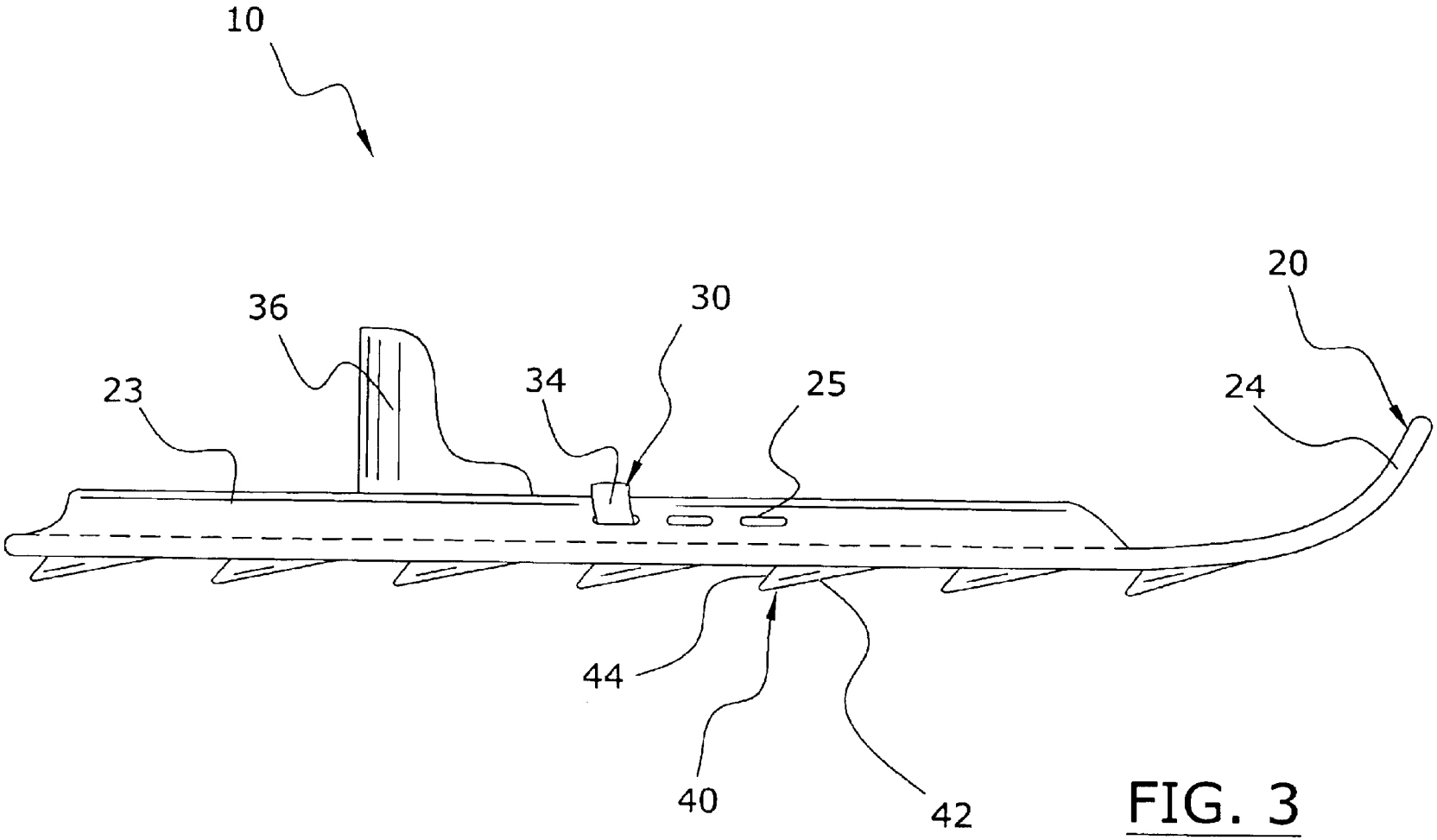
FIG. 3 is a side view of the present invention.

As shown in FIGS. 1 through 3 of the drawings, the base member 20 is comprised of a broad and elongated structure having an upper surface 26 and a lower surface 28. In use, one base member 20 will be attached upon each shoe 12 of an individual with the securing structure 30. The base member 20 in addition includes a rear end and front end as shown in FIG. 3 of the drawings. The front end of the base member 20 includes a front lip 24 that curves upwardly to allow gliding of the base member 20 upon snow and ice without catching within. The base member 20 may be comprised of any lightweight, durable material such as plastic, aluminum or fiberglass.

Figure 4:
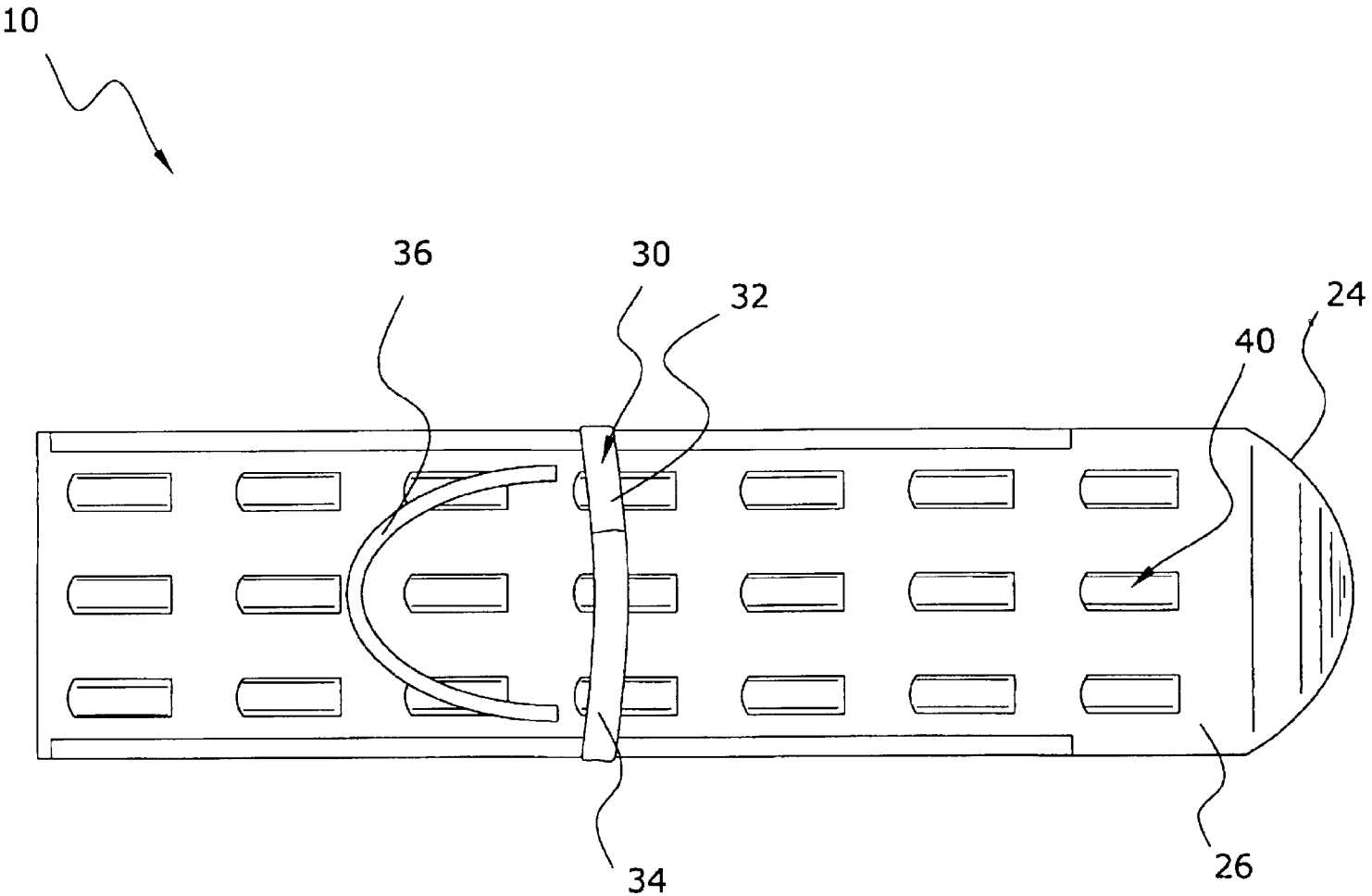
FIG. 4 is a top view of the present invention.
Figure 5:
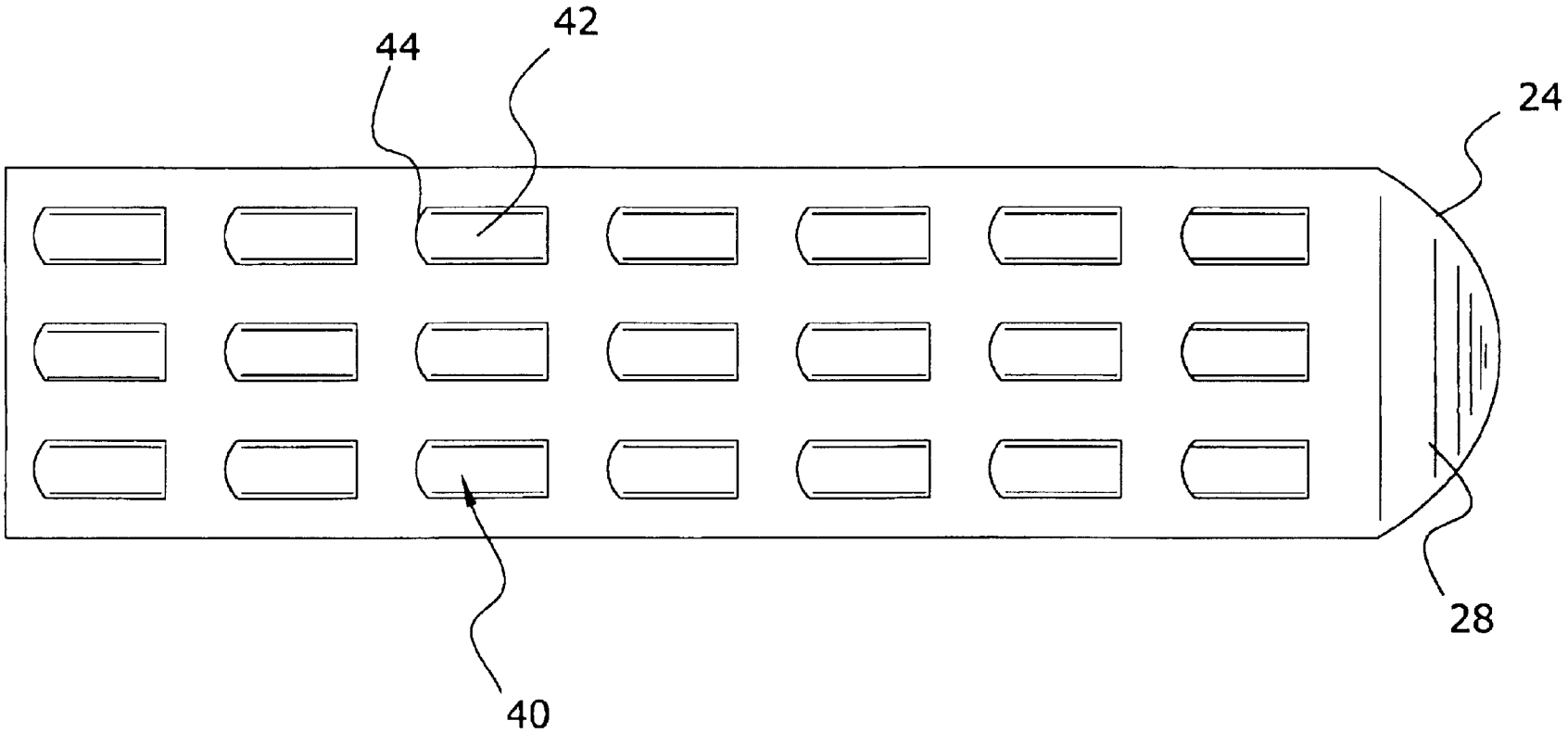
FIG. 5 is a bottom view of the present invention.

As shown in FIGS. 1 and 4 of the drawings, a first sidewall 21 and a second sidewall 23 extend upwardly from the upper surface 26 of the base member 20 in a substantially parallel manner. The sidewalls 21, 23 each include a plurality of apertures 25 within for selectively receiving the straps 32, 34 to secure shoes 12 of various sizes. The sidewalls 21, 23 extend a finite distance upwardly as shown in FIG. 3 of the drawings. The apertures 25 each are preferably comprised of a narrow structure for receiving the straps 32, 34 as best illustrated in FIGS. 1 through 3 of the drawings.

As shown in FIGS. 1 through 3 of the drawings, a plurality of gripping members 40 extend downwardly from the base member 20 with respect to the lower surface 28. The plurality of gripping members 40 preferably have a U-shaped or a semi-circular cross sectional shape, however various other shapes and designs may be utilized to construct the gripping members 40. The plurality of gripping members 40 are preferably aligned into three parallel rows as best shown in FIGS. 1, 2, 4 and 5 of the drawings.

The gripping members 40 each include a front portion 42 and a rear portion 44 as best shown in FIG. 1 of the drawings. The front portion 42 of the gripping members 40 is tapered upwardly and forwardly toward the lower surface 28 of the base member 20 to allow forward gliding upon a snow or ice surface as shown in FIG. 1 of the drawings.

The rear portion 44 of the gripping member is preferably tapered sharply upwardly to the lower surface 28 of the base member 20. The rear portion 44 is preferably a solid structure to prevent snow from entering through the base member 20. However, the rear portion 44 may alternatively be comprised of an open structure to allow snow, ice and debris to freely exit from the gripping members 40 during use. As best shown in FIG. 3 of the drawings, the rear portion 44 preferably is angled forwardly to assist in the gripping of snow or ice during a forward movement and for preventing rearward movement of the base member 20 upon a snow or ice surface.

As shown in FIGS. 1, 2, 4 and 5 of the drawings, a securing structure 30 is attached to the upper surface 26 of the base member 20 to allow selective securing of a shoe 12 to the base member 20. The securing structure 30 is comprised of a receiver structure 36, a first strap 32, and a second strap 34. The receiver structure 36 is comprised of a tapered structure formed for receiving the rear portion of a shoe 12 as best shown in FIG. 1 of the drawings. The receiver structure 36 may be comprised of a rigid, semi-rigid or flexible material.

The first strap 32 is attached to the first sidewall 21 within one of the respective apertures 25 as shown in FIG. 1 of the drawings. The first strap 32 preferably has an elongate structure for covering the front portion of the shoe 12 as shown in FIG. 1 of the drawings. The second strap 34 is attached to the second sidewall 23 within one of the respective apertures 25 as also shown in FIG. 1 of the drawings. A fastener is attached to the distal ends of the straps 32, 34 for allowing selective engagement of the straps 32, 34 about the shoe 12. The fastener may be comprised of a hook and loop fastener or other well-known fastener system.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ski system comprising:

a base member having an upper surface, a pair of opposing side edges that are parallel to one another, and a lower surface;

a first sidewall extending from said base member, and a second sidewall extending from said base member, wherein said sidewalls include a plurality of apertures within for receiving a securing strap that secures a shoe upon said base member;

wherein said first sidewall and said second sidewall extend upwardly from said opposing side edges of said base member in parallel manner;

a securing structure attached to said upper surface of said base member for catchably receiving a shoe; and a plurality of gripping members that are wedged shaped having a front portion extending downwardly from the upper surface of the base to a rear portion located below the lower surface of the base to create an open cavity in the upper surface, wherein the front portion glides upon a snow surface to allow a forward movement and the rear portion engages said snow surface for preventing rearward movement, wherein said plurality of gripping members are aligned in three parallel rows along a longitudinal axis of said base member.

2. The ski system of claim 1, wherein said front portion is tapered upwardly and forwardly to said lower surface of said base member.

3. The ski system of claim 1, wherein said front portion is curved upwardly and forwardly to said lower surface of said base member.

4. The ski system of claim 1, wherein said rear portion extends upwardly to said lower surface of said base member.

5. The ski system of claim 1, wherein said rear portion extends upwardly and at a forward angle to said lower surface of said base member.

6. The ski system of claim 1, wherein said base member includes a front lip curved upwardly.

7. The ski system of claim 1, wherein said rear portion is comprised of a closed structure.

8. The ski system of claim 1, wherein said securing structure is comprised of a receiver structure for receiving the rear portion of a shoe, a first strap attached to said first sidewall and a second strap attached to said second sidewall, wherein said straps may be connected about a front portion of said shoe.

9. The ski system of claim 8, wherein said straps are comprised of an elastic material.

10. A ski system comprising:

a base member haying an upper surface and a lower surface;

a first sidewall extending from said base member, and a second sidewall extending from said base member, wherein said sidewalls include a plurality of apertures within for receiving a securing strap that secures a shoe upon said base member;

a securing structure attached to said upper surface of said base member for catchably receiving a shoe;

a plurality of gripping members that are wedged shaped having a front portion extending downwardly from the upper surface of the base to a rear portion located below the lower surface of the base to create an open cavity in the upper surface, wherein the front portion glides upon a snow surface to allow a forward movement and the rear portion engages said snow surface for preventing rearward movement;

wherein said rear portion extends upwardly to said lower surface of said base member and wherein said rear portion extends upwardly and at a forward angle to said lower surface of front portion;

wherein said base member includes a front lip curved upwardly;

wherein said rear portion is comprised of a closed structure;

wherein said plurality of gripping members are aligned in three parallel rows along a longitudinal axis of said base member;

wherein said securing structure is comprised of a receiver structure for receiving the rear portion of a shoe, a first strap attached to said first sidewall and a second strap attached to said second sidewall, wherein said straps may be connected about a front portion of said shoe; and wherein said straps are comprised of an elastic material.

* * * * *